US009605517B2

(12) United States Patent
Buechler

(10) Patent No.: US 9,605,517 B2
(45) Date of Patent: Mar. 28, 2017

(54) WELLBORE ASSEMBLY FOR INJECTING A FLUID INTO A SUBSURFACE FORMATION, AND METHOD OF INJECTING FLUIDS INTO A SUBSURFACE FORMATION

(71) Applicant: Scott R. Buechler, Spring, TX (US)

(72) Inventor: Scott R. Buechler, Spring, TX (US)

(73) Assignee: ExxonMobil Upstream Research Company, Spring, TX (US)

( * ) Notice: Subject to any disclaimer, the term of this patent is extended or adjusted under 35 U.S.C. 154(b) by 134 days.

(21) Appl. No.: 14/388,633

(22) PCT Filed: Apr. 15, 2013

(86) PCT No.: PCT/US2013/036622

§ 371 (c)(1),
(2) Date: Sep. 26, 2014

(87) PCT Pub. No.: WO2013/184237

PCT Pub. Date: Dec. 12, 2013

(65) Prior Publication Data

US 2015/0075781 A1 Mar. 19, 2015

Related U.S. Application Data

(60) Provisional application No. 61/655,285, filed on Jun. 4, 2012, provisional application No. 61/746,485, filed on Dec. 27, 2012.

(51) Int. Cl.
*E21B 43/00* (2006.01)
*E21B 43/16* (2006.01)
(Continued)

(52) U.S. Cl.
CPC ..... *E21B 43/00* (2013.01); *E21B 17/00* (2013.01); *E21B 23/06* (2013.01); *E21B 33/12* (2013.01); *E21B 33/124* (2013.01); *E21B 33/1208* (2013.01); *E21B 33/128* (2013.01); *E21B 34/08* (2013.01); *E21B 41/0057* (2013.01); *E21B 43/14* (2013.01); *E21B 43/16* (2013.01);
(Continued)

(58) Field of Classification Search
CPC .... E21B 43/162; E21B 33/138; E21B 33/122; E21B 33/124
See application file for complete search history.

(56) References Cited

U.S. PATENT DOCUMENTS 3,547,196 A 12/1970 Closmann
7,306,043 B2 12/2007 Toekje et al.
(Continued)

FOREIGN PATENT DOCUMENTS

EP 1 865 146 A1 12/2007

*Primary Examiner* — Robert E Fuller
*Assistant Examiner* — Steven MacDonald
(74) *Attorney, Agent, or Firm* — ExxonMobil Upstream Research Company-Law Department

(57) ABSTRACT

Wellbore assembly for injecting fluid into a subsurface formation having multiple intervals comprising a plurality of packers having bypass channels at desired locations between the respective intervals. The assembly allows fluid to be injected down a tubing string, back up an annular region, and through the series of packers to impart incremental pressure drops along the intervals. The assembly enhances pressure support by allowing the operator to optimize wellbore injection along intervals having different formation characteristics.

18 Claims, 8 Drawing Sheets

(51) Int. Cl.

| | |
|---|---|
| ***E21B 33/12*** | (2006.01) |
| ***E21B 41/00*** | (2006.01) |
| ***E21B 17/00*** | (2006.01) |
| ***E21B 23/06*** | (2006.01) |
| ***E21B 33/124*** | (2006.01) |
| ***E21B 33/128*** | (2006.01) |
| ***E21B 34/08*** | (2006.01) |
| ***E21B 43/14*** | (2006.01) |
| ***E21B 44/00*** | (2006.01) |
| ***E21B 47/06*** | (2012.01) |
| ***E21B 47/12*** | (2012.01) |

(52) U.S. Cl.
CPC ..... *E21B 44/005* (2013.01); *E21B 47/06* (2013.01); *E21B 47/12* (2013.01)

(56) References Cited

U.S. PATENT DOCUMENTS

| | | | |
|---|---|---|---|
| 7,322,410 | B2 | 1/2008 | Vinegar et al. |
| 7,624,793 | B2 | 12/2009 | Freyer et al. |
| 8,770,305 | B2 | 7/2014 | Barrash et al. |
| 2002/0033266 | A1 | 3/2002 | Hester et al. |
| 2003/0024704 | A1 | 2/2003 | Hirsch et al. |
| 2006/0027378 | A1 | 2/2006 | Zimmerman |
| 2009/0025923 | A1 | 1/2009 | Patel et al. |
| 2010/0089141 | A1 | 4/2010 | Rioufol et al. |
| 2010/0089587 | A1 | 4/2010 | Stout |

WELLBORE ASSEMBLY FOR INJECTING A FLUID INTO A SUBSURFACE FORMATION, AND METHOD OF INJECTING FLUIDS INTO A SUBSURFACE FORMATION

CROSS REFERENCE TO RELATED APPLICATIONS

This application is the National Stage of International Application No. PCT/US2013/036622, filed Apr. 15, 2013, which claims the benefit of U.S. Provisional Patent Application No. 61/655,285, filed Jun. 4, 2012, and U.S. Provisional Patent Application No. 61/746,485, filed Dec. 27, 2012, the entirety of which is incorporated herein by reference for all purposes.

BACKGROUND OF THE INVENTION

This section is intended to introduce various aspects of the art, which may be associated with exemplary embodiments of the present disclosure. This discussion is believed to assist in providing a framework to facilitate a better understanding of particular aspects of the present disclosure. Accordingly, it should be understood that this section should be read in this light, and not necessarily as admissions of prior art.

FIELD OF THE INVENTION

The present disclosure relates to the field of well completions. More specifically, the present invention relates to the use of bypass packers in connection with the controlled injection of fluids into selected subsurface intervals. The application also relates to methods for injecting fluids into subsurface intervals.

DISCUSSION OF TECHNOLOGY

In the process of conducting hydrocarbon recovery operations it is oftentimes desirable to employ injection wells. These wells are sometimes referred to as "injectors."

Injectors may be used to dispose of unwanted salt water. In addition, and particularly in connection with offshore operations, injection wells may be used to dispose of cuttings. The cuttings are injected into a permeable formation as part of a slurry to avoid the dumping of oil-contaminated drill cuttings into the ocean.

Frequently, injection wells are used to inject water for pressure maintenance in subsurface formations. Alternatively or in addition, injection wells may be used to sweep oil towards producing wells, or "producers." Water is injected into one and, typically, two or more intervals simultaneously using the same injection well.

FIG. 1 presents a wellbore diagram showing a known wellbore completion for an injection well 100. The injection well includes a wellbore, shown at 115. The wellbore 115 defines a bore 105 that extends from an earth surface 101 and into an earth subsurface 110. The wellbore 115 penetrates down into a formation 120 in the subsurface 110. The formation 120 represents rock matrices having multiple distinct intervals.

The wellbore 100 is first formed by turning a drill bit at the end of a drill string (not shown). As the drill string penetrates through different depths, it forms a bore 105 having a substantially circular profile. Strings of pipe known as casing are then used to line the wellbore 115. The casing supports the surrounding formation 110 and permits additional tubular bodies and downhole tools to be run into and out of the well 100 for completion and injection. A cementing operation is typically conducted in order to fill or "squeeze" annular areas formed behind the casing. The combination of cement and casing strengthens the wellbore 115 and facilitates the isolation of the formation 110 behind the casing.

It is common to place several strings of casing having progressively smaller outer diameters into the wellbore 115. This means that the injection well 100 is drilled to a desired depth, and then strings of casing are installed. The process of drilling and then cementing progressively smaller strings of casing is repeated until the wellbore 115 has reached total depth.

In FIG. 1, a first string of casing is shown at 102. This string of casing 102 is known as surface casing. The surface casing 102 is secured in the subsurface formation 110 by a column of cement 108 that is placed around the surface casing 102. The cement column 108 isolates the wellbore 115 from any near-surface aquifers in accordance with local regulations or company protocol.

The injection well 100 also has a second string of casing, indicated at 104. This string of casing 104 is known as intermediate casing. In actual practice there may be one, two or more strings of intermediate casing 104 depending on the depth of the wellbore 115. The intermediate casing 104 is preferably also secured in the subsurface formation 110 by a cement column 108.

A final casing string, commonly known as production casing, is cemented into place. In the arrangement of FIG. 1, casing string 106 is shown. The casing string 106 is again set using a cement column 108. The casing string 106 extends through the subsurface formation 120 and various production intervals. In some instances, the final string of casing is a liner, that is, a string of casing that is not tied back to the surface 101. Such is the case here with casing string 106.

In the illustrative wellbore 115, the subsurface formation 120 traverses several different subsurface intervals. These are indicated at 112, 114, 116, 118. Several or even all of these intervals 112, 114, 116, 118 contain hydrocarbon fluids in commercially viable quantities.

The well 100 has been formed for the purpose of injecting water or other fluid. To this end, a string of injection tubing 130 is provided in the wellbore 115 within the various casing strings 102, 104, 106. The tubing 130 transports water or other fluids from the surface 101 down to the subsurface formation 120 for injection.

The wellbore 100 includes a well tree, shown schematically at 124. The well tree 124 may include a standard shut-in valve 126. The shut-in valve 126 controls the flow of fluids into and out of the tubing 130. In the case of injection well 100, the valve 126 is turned on during times of fluid injection, and turned off when the well 100 is static. It is understood that the well tree 124 receives injection fluids through a collection of pumps, pipes, valves and meters not shown. Injection operations may then commence.

A challenge frequently faced with respect to injection wells such as well 100 has to do with the controlled injection of fluids into the desired subsurface intervals 112, 114, 116, 118. It is observed that the injection fluid is released into the wellbore 115 just above or near the top of the subsurface formation 120. Typically, the fluid then exits the wellbore 115 through perforations 150 placed along the production casing 106. However, the operator has no control over the volumes of water actually injected through specific perforations 150 and into the respective intervals 112, 114, 116, 118.

Various factors can affect the injection of water into the subsurface intervals 112, 114, 116, 118. These include preferential flow due to porosity variations, variations in natural fracture networks, hydrostatic head profile, and differences in effective permeability across intervals. Additionally, perforation diameter and plugging potential in the production casing can also determine a well's conformance.

One particularly challenging factor is variations in artificially generated fractures. Hydraulically created fractures propagate more at shallower depths than at deeper depths. The larger surface area created by the larger fracture length at shallower depths will leak off more fluid into the formation 120. The perforations at the shallower interval 112 will become the preferred flow paths and receive the majority of the injected fluid, resulting in improper pressure support. As the majority of flow passes through the perforations 150 near the top of the formation 120, a stagnant flow region may develop below the top perforations 150. Stagnant flow will also negatively impact the water quality in the wellbore 115, encouraging the growth of scale and biofilm and thereby increasing the potential for plugging.

It is noted that in some instances, the injection tubing 130 may extend a certain distance into the subsurface formation 120. In this instance, fluid may be injected into the perforations 150 through an annular region formed between the injection tubing 130 and the surrounding production casing 106. However, the same challenges with respect to conformance remain.

Efforts to address non-conformance generally focus on the plugging of perforations 150 at a selected interval. The idea is to place a foam or chemical or ball sealers along the selected perforations to hinder the flow of fluids along high permeability pathways or areas with greater injectivity. However, this tends to be a temporary solution as the foam or chemical will eventually dissolve along the formation. The use of foams and chemicals can be costly and can potentially close off communication to portions of the reservoir where fluid injection is needed, thereby reducing the overall efficiency of the injection strategy.

Theoretically, varying perforation diameters at different depths across an interval could potentially lead to a modification in conformance; however, these methods also exhibit limiting circumstances. Field implementation of differing perforation sizes to impart a change in conformance can prove to be infeasible or uneconomical for a variety of reasons. These may include the need for multiple perforation guns offering different shot sizes and the need for perforation diameters below a practical limit.

Varying perforation densities across different intervals may also impart a change in conformance. This may be referred to as "limited entry." However, the same challenges remain regarding plugging, stagnant flows regions, and a limited understanding of the effect on fracturing.

It is also known to incorporate inflow control devices ("ICD's) along a tubular body for the purpose of providing selective control of fluid flow along a wellbore. ICD's typically utilize valves that are mechanically or wirelessly actuated. Incorporating ICD's into an injection strategy can achieve many of the same benefits as varying perforation diameters or limited entry. However, ICD's represent an expensive hardware addition and it is not always certain that downhole valves associated with the ICD's have actually shifted. Adding ICD's to an existing injection well completion may not be economically feasible. Further, integrating ICD's into an existing injection well may not directly address the issue of injectivity variations and could still result in stagnant flow regions in a wellbore.

Therefore, a need exists for an improved fluid injection system that controls pressure along subsurface intervals to achieve a desired uniformity in fluid injection. Further, a need exists for a subsurface fluid injection system that allows the operator to create zones of different pressure to optimize wellbore injection. In addition, a need exists for a method of injecting fluid down a wellbore and back up an annulus passing through a series of packers with restricted openings to impart pressure drops to optimize wellbore injection, vertical conformance, or pressure support.

SUMMARY OF THE INVENTION

A wellbore assembly for injecting a fluid into a subsurface formation is first provided herein. The fluid is preferably an aqueous liquid, although it may be a gas having primarily carbon dioxide or other fluid. The fluid may also be steam or a heated solvent.

In one embodiment, the wellbore assembly first includes a string of casing. The string of casing traverses at least two, and preferably at least three subsurface intervals within the subsurface formation. The subsurface intervals may represent a lower-most interval, an upper-most interval, and a first intermediate interval between the lower-most and the upper-most intervals. Additional intermediate intervals may also exist. The casing is perforated along each of the three intervals.

The wellbore assembly also has a first string of tubing. The first string of tubing extends into the string of casing along the subsurface intervals. In this way, an annulus is formed between the string of tubing and the surrounding string of casing.

The wellbore assembly also includes a first packer and a second packer. The first packer is set within the annulus proximate a top of the lower-most interval, while the second packer is set within the annulus proximate a bottom of the upper-most interval. Each of the first packer and the second packer has one or more bypass channels. The channels serve as through-openings that permit fluid communication along the annulus above and below the respective packers.

In the case of the first packer, the channels permit fluid communication between a lower annular region adjacent the lower-most interval and a first intermediate annular region adjacent the first intermediate interval. In the case of the second packer, the channels permit fluid communication between an upper-most annular region adjacent the upper-most interval and the first intermediate annular region. The bypass channels in the first packer and in the second packer are sized to impart incremental pressure drops through the annulus to optimize fluid injection into each of the at least three subsurface intervals.

In one embodiment, each of the first packer and the second packer is instrumented to monitor (i) flow rate, (ii) wellbore temperature, (iii) absolute pressure, (iv) differential pressure, or (v) combinations thereof.

The wellbore assembly also includes a sealing packer. The sealing packer is set within the annulus above or proximate a top of the upper-most interval. This serves to seal the annulus above the subsurface intervals.

The wellbore assembly is described above in connection with providing at least two pressure drops—one through each of the first and second packers. However, additional "bypass" packers may be used for providing additional pressure drops across additional intervals. Thus, in one aspect the wellbore assembly includes a third packer. The third packer is set within the annulus proximate a top of the first intermediate interval. The third packer has one or more bypass channels to permit fluid communication between the first annular region and a second intermediate annular region adjacent a second intermediate interval that is between the first intermediate interval and the upper-most interval. The channels in the third packer are sized to impart an incremental pressure drop as fluid moves up the annulus from the first intermediate annular region into the second intermediate annular region. If only four subsurface intervals are receiving fluid, the second packer is set proximate a top of the second intermediate interval, that is, essentially between the second intermediate interval and the upper-most interval.

Preferably, each of the first packer and the second packer is threadedly connected to joints of the string of tubing. In one aspect, only the first string of tubing is used. However, in another embodiment a second string of tubing is also used. The second string of tubing extends along at least the upper-most interval. Here, the sealing packer and at least the third packer are configured to threadedly receive each of the first string of tubing and the second string of tubing.

A method of injecting a fluid into a subsurface formation is also provided herein. The method is implemented in connection with an injection well having a subsurface formation that has at least two, and preferably at least three subsurface intervals. The intervals may define a lower-most interval, an upper-most interval, and a first intermediate interval between the lower-most and the upper-most intervals.

In one aspect, the method includes running a string of injection tubing into the wellbore. The wellbore is lined with a string of casing that traverses each of the subsurface intervals. Moreover, the casing is perforated along each of the intervals. An annulus is formed between the tubing and the surrounding perforated casing.

The method also includes setting a first packer in the annulus proximate a top of the lower-most interval. The method further includes setting a second packer within the annulus proximate a bottom of the upper-most interval.

Each of the first packer and the second packer has one or more bypass channels. The channels permit fluid communication along the annulus above and below the respective packers. In the case of the first packer, the channels permit fluid communication between a lower annular region adjacent the lower-most interval and a first intermediate annular region adjacent the first intermediate interval. In the case of the second packer, the channels permit fluid communication between an upper-most annular region adjacent the upper-most interval and the first intermediate annular region. The bypass channels in the first packer and in the second packer are sized to impart incremental pressure drops through the annulus to optimize fluid injection into the at least three subsurface intervals.

In one embodiment, each of the first packer and the second packer is instrumented to monitor (i) flow rate, (ii) wellbore temperature, (iii) absolute pressure, (iv) differential pressure, or (v) combinations thereof.

The method also includes setting a sealing packer. The sealing packer is set within the annulus above or proximate a top of the upper-most interval. This serves to seal the annulus above the subsurface intervals.

The method further includes injecting fluids down the string of injection tubing. The fluid reaches the bottom of the wellbore, then flows back up the annulus, through the channels in the first and second packers, and into each of the at least three subsurface intervals. The one or more channels in the first packer and the second packer are sized to impart incremental pressure drops to optimize fluid injection into the subsurface intervals.

The method is described above in connection with providing at least two pressure drops—one through each of the first and second packers. However, additional "bypass" packers may be set for providing additional pressure drops across additional intervals. Thus, in one aspect, the method includes setting a third packer. The third packer is set within the annulus proximate a top of the first intermediate interval. The third packer also has one or more bypass channels to permit fluid communication between the first annular region and a second intermediate annular region adjacent a second intermediate interval between the first intermediate interval and the upper-most interval.

In this instance, the step of injecting fluids further comprises injecting fluids through the channels in the third packer. The one or more channels in the third packer are sized to impart an incremental pressure drop as fluid moves up the annulus from the first intermediate annular region into the second intermediate annular region. If only four subsurface intervals are receiving fluid, the second packer is set proximate a top of the second intermediate interval, that is, essentially between the second intermediate interval and the upper-most interval.

Preferably, each of the first packer and the second packer is threadedly connected to joints of the string of tubing. Setting the packers will include threadedly connecting the packers along the string of tubing as the tubing is being run into the wellbore. In one aspect, only the first string of tubing is used. However, in another embodiment a second string of tubing is also used. The second string of tubing extends along at least the upper-most interval. Here, the sealing packer and at least the third packer are configured to threadedly receive each of the first string of tubing and the second string of tubing. In this instance, the method further comprises running a second string of tubing into the wellbore, the second string of tubing extending along at least the upper-most interval.

BRIEF DESCRIPTION OF THE DRAWINGS

So that the manner in which the present inventions can be better understood, certain illustrations, charts and/or flow charts are appended hereto. It is to be noted, however, that the drawings illustrate only selected embodiments and features of the inventions and are therefore not to be considered limiting of scope, for the inventions may admit to other equally effective embodiments and applications.

FIG. 4A shows most of the channels in the packer being sealed to fluid flow by means of plugs.

FIG. 4B shows the plugs having been removed from two of the larger channels from FIG. 4A, and from one of the smaller channels.

FIG. 4C shows all of the plugs having been removed from all of the channels. The channels together form a cross-sectional area for flow-through of fluids.

FIG. 5A shows most of the channels being sealed to fluid flow by means of plugs.

FIG. 5B shows plugs having been removed from two of the channels from FIG. 5A.

FIG. 5C shows all of the plugs having been removed from all of the channels.

DETAILED DESCRIPTION OF CERTAIN EMBODIMENTS

Definitions

Figure 1:
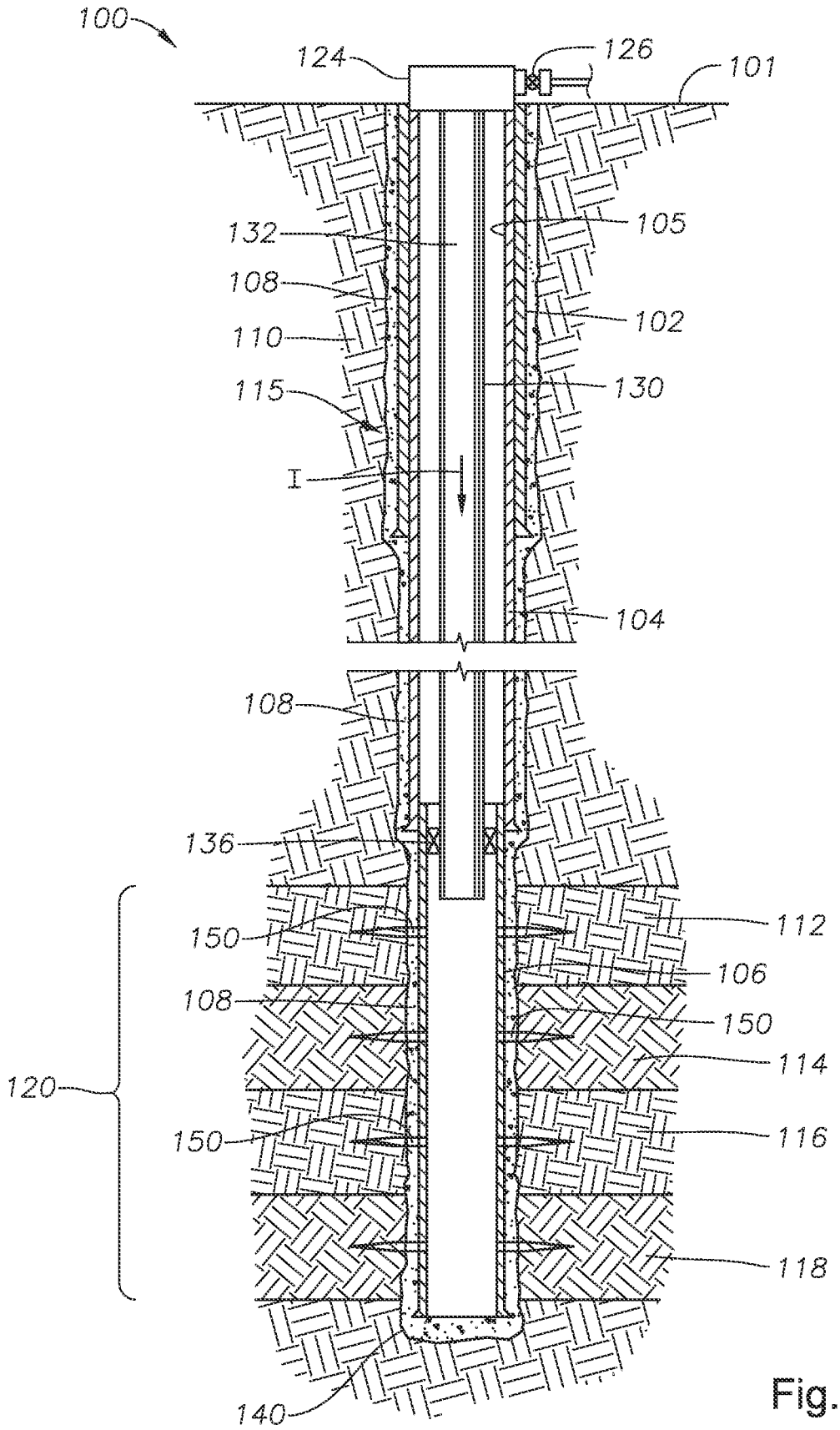
FIG. 1 is a cross-sectional view of an illustrative wellbore. The wellbore has been drilled through multiple subsurface intervals, each interval being under formation pressure and containing fluids. The wellbore is formed for the purpose of injecting fluids into the intervals.

As used herein, the term "hydrocarbon" refers to an organic compound that includes primarily, if not exclusively, the elements hydrogen and carbon. Hydrocarbons generally fall into two classes: aliphatic, or straight chain hydrocarbons, and cyclic, or closed ring hydrocarbons, including cyclic terpenes. Examples of hydrocarbon-containing materials include any form of natural gas, oil, coal, and bitumen that can be used as a fuel or upgraded into a fuel.

As used herein, the term "hydrocarbon fluids" refers to a hydrocarbon or mixtures of hydrocarbons that are gases or liquids. For example, hydrocarbon fluids may include a hydrocarbon or mixtures of hydrocarbons that are gases or liquids at formation conditions, at processing conditions or at ambient conditions (15° C. and 1 atm pressure). Hydrocarbon fluids may include, for example, oil, natural gas, coal bed methane, shale oil, pyrolysis oil, pyrolysis gas, a pyrolysis product of coal, and other hydrocarbons that are in a gaseous or liquid state.

As used herein, the term "fluid" refers to gases, liquids, and combinations of gases and liquids, as well as to combinations of gases and solids, and combinations of liquids and solids.

As used herein, the term "subsurface" refers to geologic strata occurring below the earth's surface.

As used herein, the term "wellbore" refers to a hole in the subsurface made by drilling or insertion of a conduit into the subsurface. A wellbore may have a substantially circular cross section, or other cross-sectional shape. As used herein, the term "well," when referring to an opening in the formation, may be used interchangeably with the term "wellbore."

The terms "tubular member" or "tubular body" refer to any pipe or tubular device, such as a joint of casing or base pipe, a portion of a liner, or a pup joint.

DESCRIPTION OF SPECIFIC EMBODIMENTS

The inventions are described herein in connection with certain specific embodiments. However, to the extent that the following detailed description is specific to a particular embodiment or a particular use, such is intended to be illustrative only and is not to be construed as limiting the scope of the inventions.

Certain aspects of the inventions are also described in connection with various figures. In certain of the figures, the top of the drawing page is intended to be toward the surface, and the bottom of the drawing page toward the well bottom. While wells commonly are completed in substantially vertical orientation, it is understood that wells may also be inclined and or even horizontally completed. When the descriptive terms "up and down" or "upper" and "lower" or similar terms are used in reference to a drawing or in the claims, they are intended to indicate relative location on the drawing page or with respect to claim terms, and not necessarily orientation in the ground, as the present inventions have utility no matter how the wellbore is orientated.

In addition, certain figures and claims refer to intervals as being the "upper-most interval" or "the lower-most interval." It is understood that a formation may have multiple distinct intervals, but with some intervals being sealed to production or injection. Therefore, for purposes of the present disclosure and claims, the terms "upper-most" and "lower-most" refer to the upper and lower intervals that are the subject of fluid injection.

Figure 2:
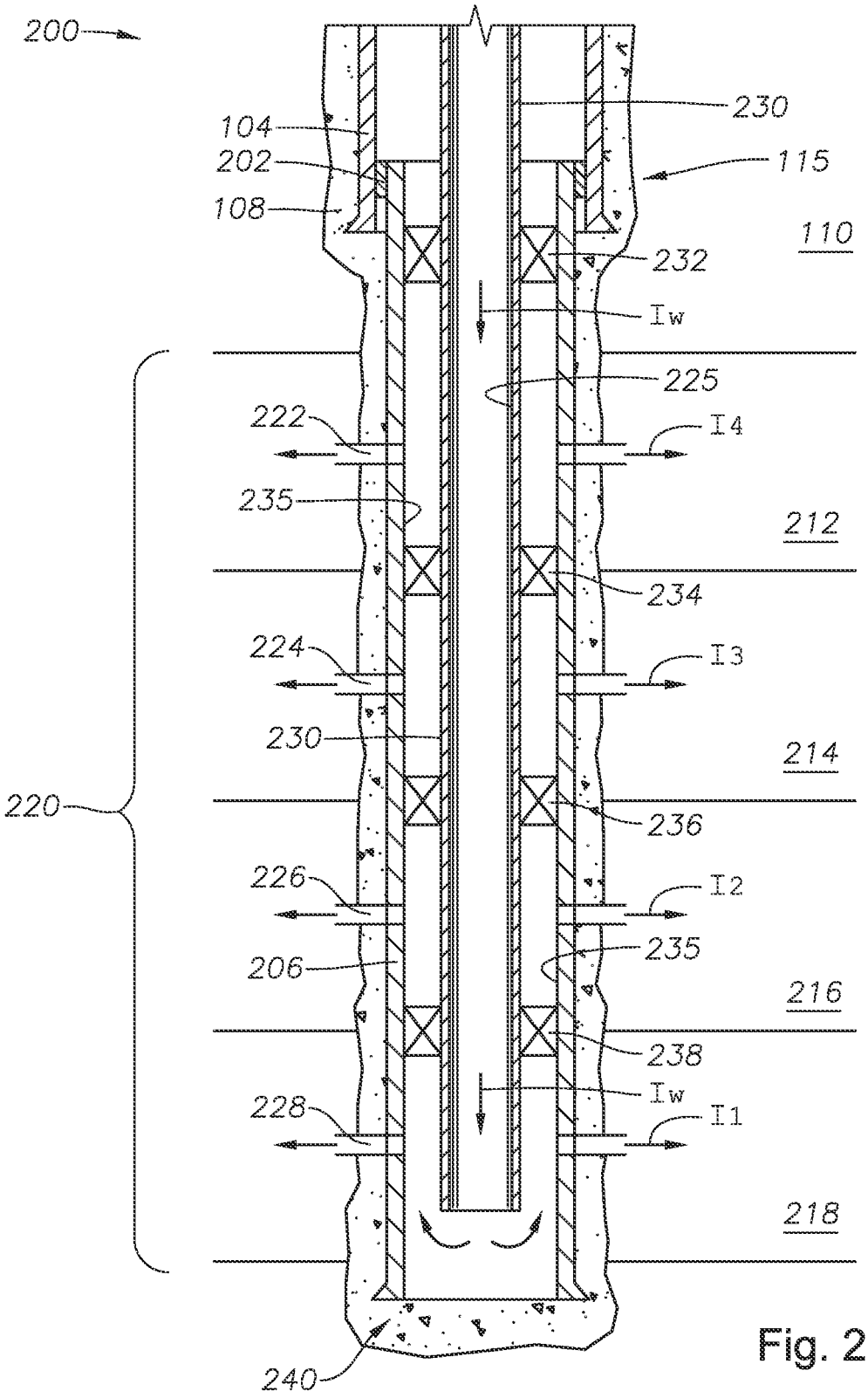
FIG. 2 is an enlarged cross-sectional view of a lower portion of an injection well. Here, production casing is shown traversing four illustrative subsurface intervals. Packers having bypass channels are placed between the intervals to create controlled pressure drops in the annulus. The injection tubing and packers form a wellbore assembly for an injection well.

FIG. 2 is an enlarged cross-sectional view of a lower portion of a wellbore 200. The wellbore 200 is part of an injection well, such as well 100 of FIG. 1. It is seen that the wellbore 200 extends through the subsurface 110 and is completed in a subsurface formation 220. The subsurface formation 220 has four illustrative intervals. These are shown at 212, 214, 216 and 218.

Extending through the subsurface intervals 212, 214, 216, 218 is a string of lower casing 206. The lower casing 206 may be considered as a string of production casing, although the wellbore 200 is designed for fluid injection. The lower casing 206 is hung from an intermediate string of casing, shown at 104. A liner hanger is shown at 202 for hanging the lower string of casing 206 from the intermediate string of casing 104. Both the lower string of casing 206 and the intermediate string of casing 104 are cemented into the subsurface 110 using a column of cement 108.

The lower casing 206 is perforated along each of the subsurface intervals 212, 214, 216, 218. An upper interval 212 is perforated at 222, while a lower interval 218 is perforated at 228. In addition, a first intermediate interval 216 is perforated at 226, while a second intermediate interval 214 is perforated at 224.

The wellbore 200 has received a string of tubing 230. The tubing string 230 represents a string of injection tubing. The injection tubing 230 extends from a surface (such as surface 101 in FIG. 1) down proximate a bottom 240 of the wellbore 200. The injection tubing 230 has a bore 225 through which fluids are injected. A sealing packer 232 is provided along the injection tubing 230. The sealing packer 232 seals an annulus 235 between the tubing 230 and the surrounding casing 206.

In the wellbore 200, arrows "I" are shown, indicating an injection of water. These are designated as follows:

- Arrow $I_w$ represents the injection of water into the wellbore through the bore 225 of the tubing 230;
- Arrow $I_1$ represents the injection of water through perforations 228 along the lower-most interval 218;
- Arrow $I_2$ represents the injection of water through perforations 226 along the first intermediate interval 216;
- Arrow $I_3$ represents the injection of water through perforations 224 along the second intermediate interval 214; and
- Arrow $I_4$ represents the injection of water through perforations 222 along the upper-most interval 212.

In the wellbore 200, additional packers are provided along the annulus 235. These are unique bypass packers that are set proximate transition depths between the respective intervals 212, 214, 216, 218. Three illustrative bypass packers are shown. These are:

- Packer 234 set proximate the top of the second intermediate interval 214;
- Packer 236 set proximate the top of the first intermediate interval 216; and
- Packer 238 set proximate the top of the lower-most interval 218.

Sealing packer 232 resides above or near the top of the upper-most interval 212.

In order to facilitate the injection of water into the subsurface intervals 212, 214, 216, 218, the packers 234, 236, 234 have bypass channels. Bypass channels are not seen in FIG. 2; however, bypass channels are schematically shown in the cross-sectional view of FIG. 3.

Figure 3:
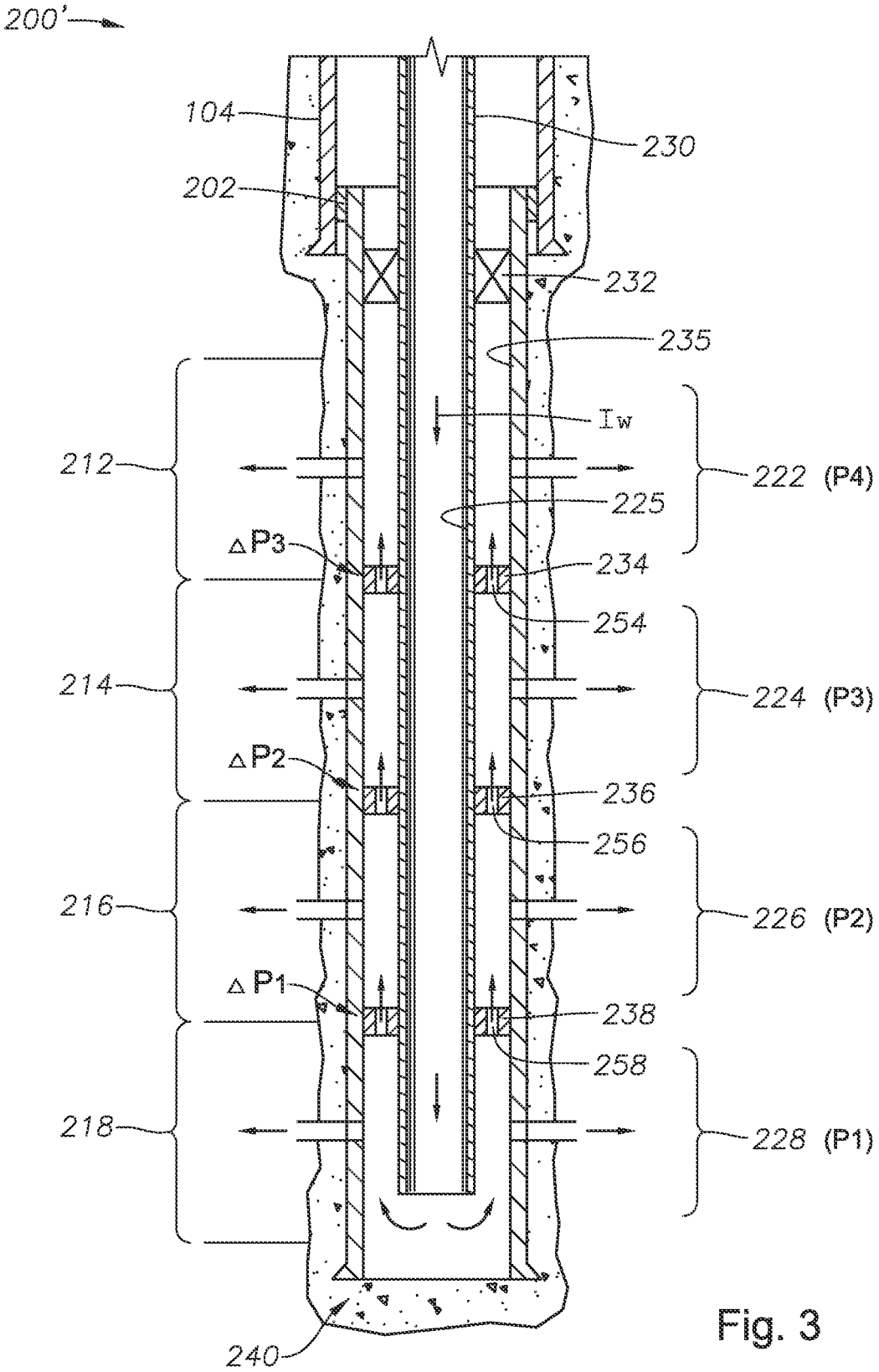
FIG. 3 is a more schematic cross-sectional view of a lower portion of the wellbore of FIG. 2. Incremental pressure drops are illustrated by the placement of bypass packers along the string of injection tubing. Bypass channels are shown schematically in the packers.

FIG. 3 provides another cross-sectional view of the wellbore 200 of FIG. 2. In FIG. 3, the wellbore is more schematic, and is identified at 200'. The lower string of casing 206 is again seen hanging from intermediate casing string 104 by means of the liner hanger 202. Further injection tubing 230 is seen, with an annulus 235 being formed between the tubing 230 and the surrounding lower string of casing 206. The sealing packer 232 is also seen above the upper-most interval 212.

In FIG. 3, the subsurface intervals are shown as pressure zones. The pressure zones are identified as follows:

- Lower-most interval 228 is at a first pressure $P_1$;
- First intermediate interval 226 is at a second pressure $P_2$;
- Second intermediate interval 224 is at a third pressure $P_3$; and
- Upper-most interval 222 is at a fourth pressure $P_4$.

The bypass packers 232, 234, 236 create pressure differentials in the annulus 235 between the subsurface intervals. The pressure differentials are indicated as follows:

- First pressure differential $\Delta P_1$ at packer 238 between intervals 218 and 216;
- Second pressure differential $\Delta P_2$ at packer 236 between intervals 216 and 214; and
- Third Pressure differential $\Delta P_3$ at packer 234 between intervals 214 and 212.

The pressure differentials $\Delta P_1$, $\Delta P_2$ and $\Delta P_3$ represent incremental pressure drops along the annulus 235 in the intervals 212, 214, 216, 218. The pressure drops are a result of bypass channels 258, 256, 254 placed in the packers 238, 236, 234, respectively. The channels 258, 256, 254 serve as through-openings that are sized to create controlled pressure drops in the annulus 235. Thus:

Pressure $P_1$ is>pressure $P_2$, where $\Delta P_1 = P_1 - P_2$;

Pressure $P_2$ is>pressure $P_3$, where $\Delta P_2 = P_2 - P_3$; and

Pressure $P_3$>pressure $P_4$, where $\Delta P_3 = P_3 - P_4$.

In the view of FIG. 3, the bypass channels 258, 256, 254 are represented by a single through-opening. However, it is understood that the bypass channels 258, 256, 254 may be comprised of a number of separate channels having uniform or even different diameters. Further, selected channels may be closed to adjust the overall area "A" of a bypass channel, as discussed below in connection with FIGS. 4A, 4B and 4C, and in connection with FIGS. 5A, 5B and 5C.

Referring again to FIGS. 2 and 3 together, the perforated production casing 206, the injection tubing 230, the sealing packer 232, and the bypass packers 238, 236, 234 together form a novel wellbore assembly. The assembly allows an operator to inject a fluid down a wellbore 200 and back up the annulus 235, with the fluid passing through a series of packers 238, 236, 234 having restricted openings 258, 256, 254. The bypass packers 234, 236, 238 are placed at desired intervals to impart incremental pressure differentials, or pressure drops $\Delta P_1$, $\Delta P_2$, $\Delta P_3$. The pressure drops $\Delta P_1$, $\Delta P_2$, $\Delta P_3$, in turn, allow the operator to control pressures $P_1$, $P_2$, $P_3$, $P_4$ along the subsurface formation 200. In this way each interval 218, 216, 214, 211 receives injection fluid as designed.

Bernoulli's principle states that there is a relationship between the pressure of a fluid and the flow velocity of the fluid. In the context of petroleum engineering, the change in pressure is a function of flow rate, the number of channels, and the diameter of the channels. A pressure drop across a flow restriction for an incompressible fluid may be mathematically defined as follows:

$$\Delta P = \frac{(0.237 \times \rho \times Q^2)}{(N^2 \times C_p^2 \times D^4)}$$

where 0.237=a unit conversion coefficient;

ρ=density of the fluid (for brine, about 8.56 lb/gal);

Q=flow rate (bbl/min)

N=no. of open channels;

$C_p$=orifice coefficient; and

D=diameter (in.)

The orifice coefficient is generally defined as:

$$C_p = 0.459 \times e^{(1.5187 \times D)}$$

wherein the values 0.459 and 1.5187 are empirically determined constants.

Using this principle, fluid is injected at the top of the wellbore 200. The fluid is preferably salt water. The injected fluid flows down the length of the tubing 230 and to the bottom 240 of the wellbore 200. The fluid then flows up the annulus 235 around the injection tubing 230. As the fluid travels back up the annulus 235, it encounters the series of packers 238, 236, 234, 232. The packers 238, 236, 234 have restricted openings, termed herein as bypass channels 258, 256, 254. The bypass channels 258, 256, 254 provide through-flow areas for the respective packers 238, 236, 234, and are sized to impart designed pressure drops $\Delta P_2$, $\Delta P_2$, $\Delta P_3$.

In operation, fluid first flows along the lower-most interval 228 up to the lower-most packer 238. Some of the fluid is injected through the perforations 228, while some fluid flows on through the lower-most packer 238. Following the lower-most packer 238, the fluid flow will be split between casing perforations 226 (along the first intermediate interval 216) and the next bypass packer 236. "N" bypass packers can be placed in series to impart "N" pressure drops and "N+1" isolated zones of decreasing pressure.

Fluid continues to flow along the annulus 235 where the fluid flow is split between any additional intermediate intervals (such as second intermediate interval 214) and the upper-most interval 212. The fluid is prevented from flowing up the annulus 235 all the way to the surface 101 by the "sealing" packer 232. This is a traditional packer used to contain the fluid in the annulus 235 at some depth above the subsurface formation 220.

The result of the wellbore assembly shown in FIGS. 2 and 3 is isolated, controllable zones of different pressures. By controlling zones of pressure, wellbore injection can be optimized. This is done by injecting fluids from a created annulus. This is contrary to the typical injection well in which fluid flows down the tubing or annulus and then contacts the formation through perforations. This helps prevent regions of stagnant flow, and also helps prevent a more porous and permeable interval from taking a disproportionately large percentage of injected fluid.

It is also common for the interval at the shallowest depth to "thief" injected fluid, leaving regions of static flow at the lower intervals. In some cases, hydraulic fractures may propagate to a greater extent at shallower depths, leaving a zone in which injected fluid will more readily invade.

In any of the above situations, the methodology of flowing fluid from the bottom of the wellbore back up the annulus will continuously "flush" the annulus 235, substantially reducing or even eliminating thief zones and stagnant regions.

Figure 4A:
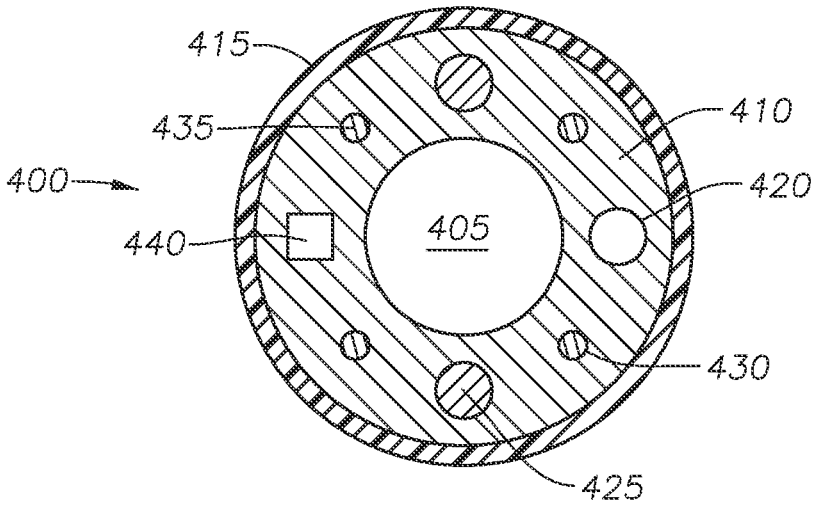
FIG. 4A, FIG. 4B and FIG. 4C present cross-sectional views of a bypass packer as may be used in the wellbore assembly of FIGS. 2 and 3. The packer is configured to receive a single string of injection tubing.
Figure 4B:
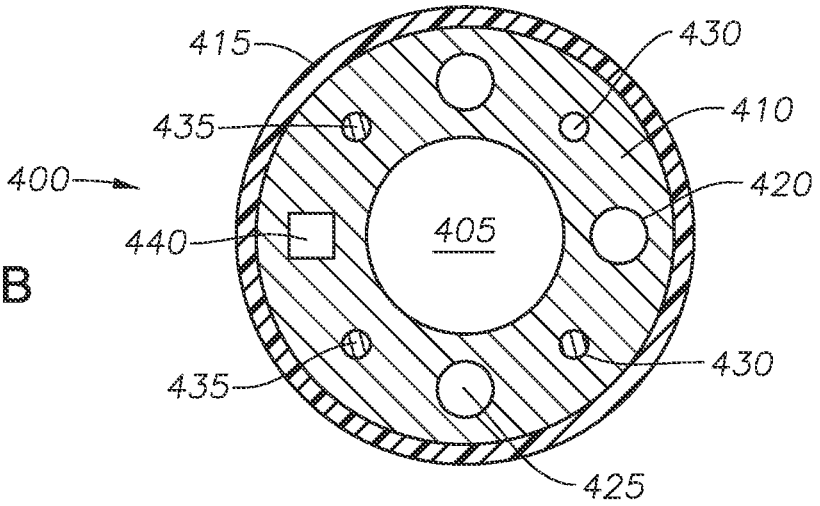
Figure 4C:
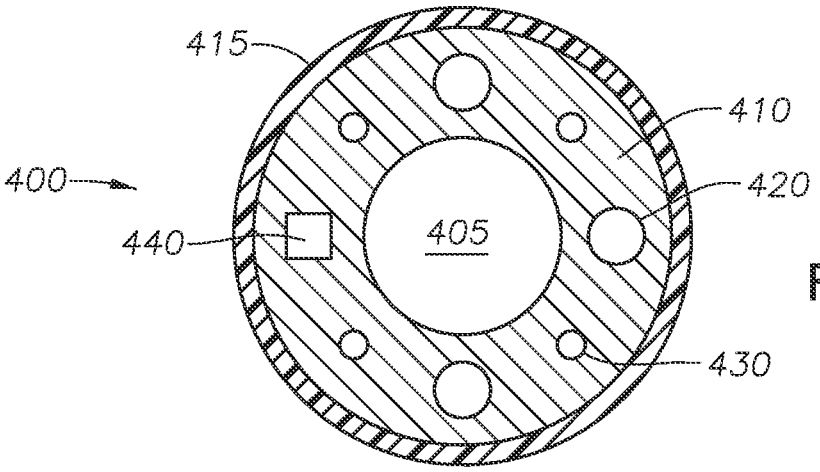

Various designs for the bypass packers 234, 236, 238 may be employed. FIGS. 4A, 4B and 4C present cross-sectional views of a bypass packer 400 as may be used in the wellbore assemblies of FIGS. 2 and 3, in one embodiment. The bypass packer 400 is configured to receive a single string of injection tubing, such as tubing 230.

First, FIG. 4A shows the packer 400 as having a body 410. The body 410 forms a central bore 405 through which injection fluids flow. The central bore 405 is in full fluid communication with the bore 225 of the tubing 230. Placed circumferentially around the body 410 is an elastomeric ring 415. The elastomeric ring 415 helps seal the annulus 235 when the packer 400 is set.

Disposed within the body 410 is one or more channels 420. In the illustrative arrangement of FIG. 4A, three channels are shown at 420, each having a first diameter. Further, four channels are shown at 430 having a second smaller diameter. In FIG. 4A, two of the larger channels 420 are sealed with a plug 425, while each of the four smaller channels 430 is sealed to fluid flow by means of a smaller plug 435.

The channels 420, 430 together form through-openings for injected fluid, allowing the fluid to flow up the annulus 235 as described above. The channels 420, 430 define a flow area "A" calculated according to the formula:

$$A=[O\times\pi\cdot R_O^2]+[S\times\pi\cdot R_s^2]$$

where

O=the number of larger (unplugged) channels 420

S=the number of smaller (unplugged) channels 430

$R_O$=the radius of the larger channels 420

$R_s$=the radius of the smaller channels 430

It is desirable to be able to adjust the value of the cross-sectional area "A" in the packer 400. This enables the operator to adjust the pressure differential across the packer 400. This may be done by selectively plugging or unplugging channels 420, 430.

FIG. 4B is a second cross-sectional view of the same packer 400. Here, the plugs 425 have been removed from two of the larger channels 420. None of the larger channels 420 remain plugged, thereby increasing the flow-through area "A". Further, one plug 435 has been removed from one of the smaller channels 430.

As an illustration, the number of unplugged larger channels 420 in FIG. 4B is three. The diameter of the larger channels 420 may be, for example, 0.5 inches (1.27 cm). The number of unplugged smaller channels 430 is one. The diameter of the smaller channels 430 may be, for example, 0.25 inches (0.64 cm). Therefore, $$\begin{aligned} A &= [3\times\pi\cdot(0.250)^2]+[1\times\pi\cdot(0.124)^2] \\ &= 0.59+0.50 \\ &= 1.09\ \text{in}^2(7.03\ \text{cm}^2) \end{aligned}$$

FIG. 4C is still another cross-sectional view of the same packer 400. Here, the plugs 435 have been removed from the smaller channels 430. Now, none of the channels 420, 430 remain plugged, thereby maximizing the flow-through area "A". This provides the smallest pressure drop across the packer 400.

It is also desirable to be able to monitor certain downhole conditions associated with the packer 400. This may include flow rate through the channels (420 or 430), temperature, differential pressure, or absolute pressure above and/or below a packer 400. To this end, a sensor 440 may be provided on the packer 400. Data may be collected and stored on a memory associated with the sensor 440 for later retrieval and study. Alternatively, data may be transmitted up-hole in real time, such as by means of fiber optic cable (not shown) that passes through the tubing 130. Alternatively still, one or more sensors may be powered and communicated with using a surface-controlled processor and user interface via wireless signal.

As noted, the bypass packer 400 is configured to receive a single string of injection tubing through a single bore 405. However, the packer 400 may be re-configured to receive two separate strings of injection tubing through twin bores.

Figure 5A:
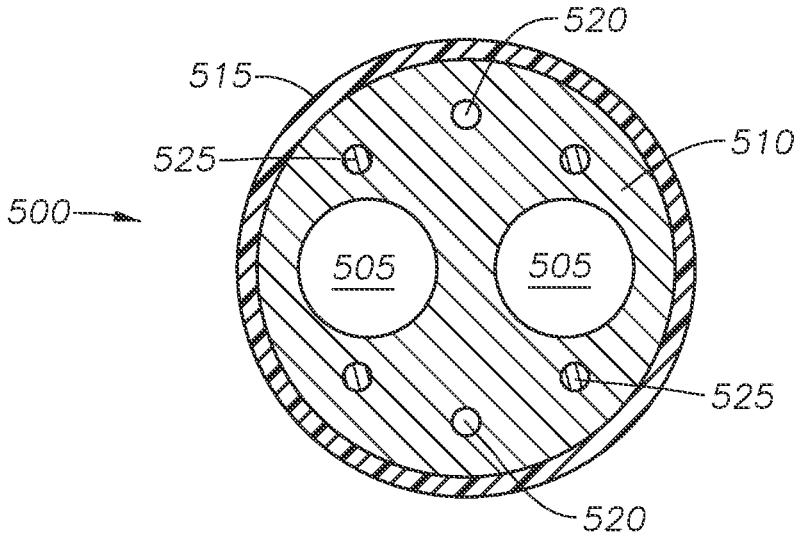
FIG. 5A, FIG. 5B and FIG. 5C present cross-sectional views of a bypass packer as may be used in a wellbore assembly in an alternate embodiment. Here, the bypass packer is configured to receive two strings of injection tubing.
Figure 5B:
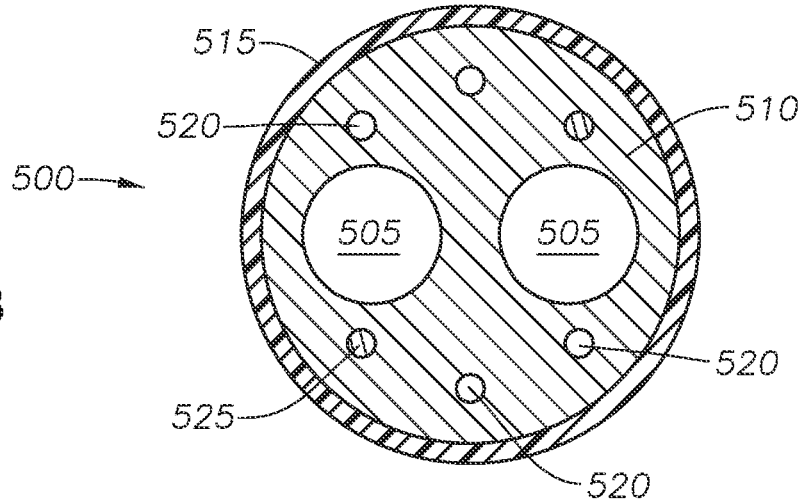
Figure 5C:
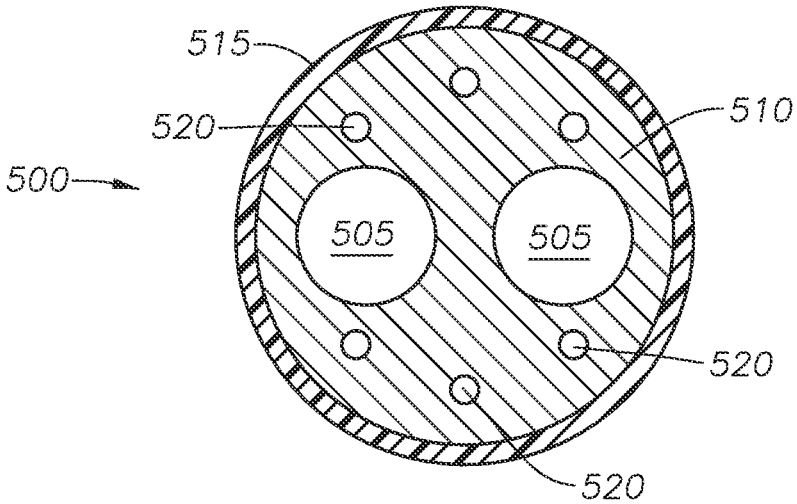

FIGS. 5A, 5B and 5C present cross-sectional views of a bypass packer 500, in an alternate embodiment. Here, the bypass packer 500 is configured to receive two strings of injection tubing (not shown). Two strings of tubing may be used for injection into separately isolated zones or sets of zones.

First, FIG. 5A shows the packer 500 as having a body 510. The body 510 includes two central bores 505 through which injection fluids flow. The central bores 505 are in full fluid communication with the bores of separate tubing strings (not shown). Placed circumferentially around the body 510 is an elastomeric ring 515. The elastomeric ring 515 helps seal the annulus 235 when the packer 500 is set.

Disposed within the body 510 is one or more channels 520. In the illustrative arrangement of FIG. 5A, six channels 520 are shown. Each channel has a diameter that may receive a plug 525. In the view of FIG. 5A, four of the six channels 520 have received a plug 525. In this way, a partial and controlled restriction of fluid flow through the packer 500 is provided.

The operator may choose to remove one or more of the plugs 525 in order to increase fluid flow through and decrease the accompanying pressure drop across the packer 500. FIG. 5B is a second cross-sectional view of the same packer 500. Here, two of the plugs 525 have been removed from the channels 520. This provides for four open channels 520.

The open channels 520 form bypass channels for injected fluid, allowing the fluid to flow up the annulus 235 as described above. The channels 520 define a flow area "A" calculated according to the formula:

$$A=[O\times\pi\cdot R_O^2]$$

where

O=the number of (unplugged) channels 520

$R_O$=the radius of the channels 520

As an illustration, the number of unplugged channels in FIG. 5B is four. The diameter of the channels 520 may be, for example, 0.5 inches (1.27 cm). Therefore, $$A = [4\times\pi\cdot(0.25)^2]$$

$$= 0.78\ \text{in}^2(5.03\ \text{cm}^2)$$

FIG. 5C is still another cross-sectional view of the same packer 500. Here, the plugs 525 have been removed from all of the channels 520. None of the channels 520 remain plugged, thereby maximizing the flow-through area "A". This provides the smallest pressure drop across the packer 500.

It is understood that the number of channels and the diameter of individual channels in either of the packers 400, 500 may be changed. These are designer's choice. What is important is that the operator be able to selectively adjust the flow-through area "A" for the packer 400 or 500 for tuned pressure drops.

It is contemplated that the packers 400, 500 are secured inside a wellbore through threaded connections with joints of tubing 230 at selected depths. Further, the individual plugs 425, 435 or 525 are mechanically installed by the manufacturer or the operator in response to engineering design instructions. The plugs 425, 435, 525 may be small solid bodies that have external threads that screw into internal threads in the channels 420, 430 or 520. In this instance, the plugs 425, 435 or 525 may be selectively installed and removed using a screw-driver or power drill. However, other arrangements for manipulating the area "A" of through-openings may be employed.

Figure 6:
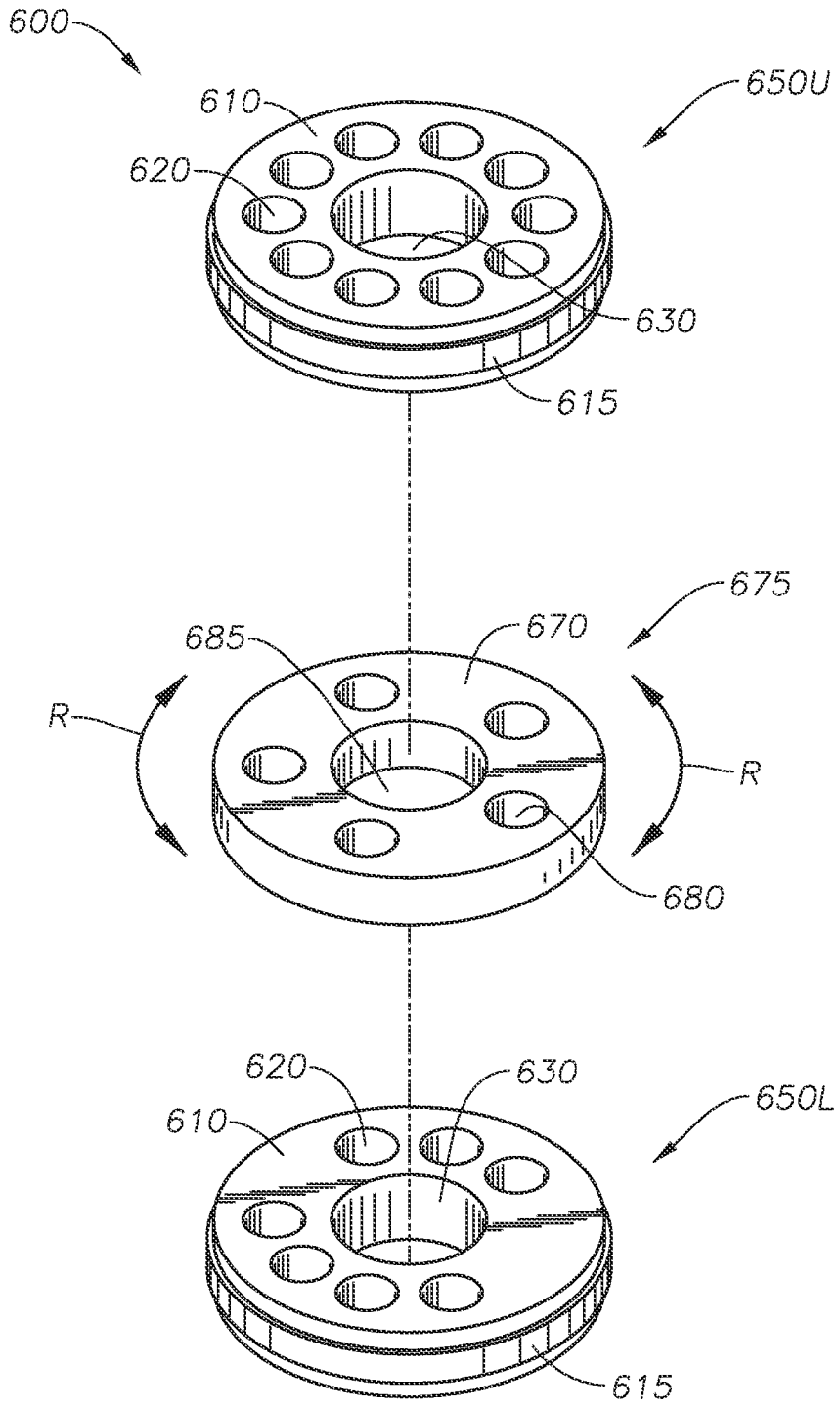
FIG. 6 is an exploded perspective view of a bypass packer as may be used in the wellbore assembly of FIGS. 2 and 3, in an alternate embodiment. The packer has bypass channels and is configured to receive a single string of injection tubing.

FIG. 6 provides an alternative arrangement for a bypass packer 600 having bypass channels 620. In FIG. 6, the packer 600 is shown in an exploded perspective view. The packer 600 may be used in the wellbore assembly of FIGS. 2 and 3.

The illustrative packer 600 has three separate discs. These are an upper disc 650U, a lower disc 650L, and an intermediate rotatable disc 675. The upper disc 650U and the lower disc 650L each comprise a cylindrical body 610. The cylindrical bodies 610 each have a central bore 630 for receiving injection fluids. The bores 630 are in fluid communication with the bore 225 of a single string of injection tubing (shown at 230 in FIG. 2). In addition, each disc 650U, 650L has an elastomeric ring 615.

Formed within the cylindrical bodies 610 are a plurality of bypass channels 620. Ten separate channels 620 are shown in the upper disc 650U, while seven channels are shown in the lower disc 650L. In operation, channels 620 in the upper 650U and lower 650L discs are aligned to provide through-openings for the flow of water in the annulus 235 after the packer 600 is set.

As noted, the packer 600 also has an intermediate disc 675. The intermediate disc 675 is rotatable relative to the upper 650U and lower 650L discs. The intermediate disc 675 may be in the nature of a gasket fabricated from steel, ceramic, or other hardened material. The intermediate disc 675 has a central bore 685 that generally aligns with the central bore 630 of the upper 650U and lower 650L discs. The intermediate disc 675 comprises a body 670 having multiple through-openings, or channels 680. Depending on the relative rotation of the lower disc 650L and the intermediate disc 675, the channels 680 may permit fluid flow through two, three or five of the channels 620 of the upper 650U and the lower 650L discs.

Arrows "R" are shown in FIG. 6. The arrows "R" indicate rotational movement of the intermediate disc 675 relative to the upper 650U and lower 650L discs. The intermediate disc 675 may ride on radial slots and bearings (not shown) between the upper 650U and lower 650L discs. The position of the intermediate disc 675 relative to the upper 650U and lower 650L discs is preferably set by the engineer or service team at the surface according to the number of channels 620 that are to be aligned to receive fluid flow.

The bypass packers 400, 500, 600 are shown only in cross-section, at a location of the channels. It is understood that the packers 400, 500, 600 are actually elongated tubular tools having an outer diameter dimensioned to fit within the surrounding casing 230. The elastomeric rings 415, 515, 615 may not be at the exact cross-sectional location of the channels 420, 520, 620. The rings 415, 515, 615 may be compressed or otherwise extruded outwardly into contact with the casing 130 by means of a setting tool (not shown). The setting tool may be run into the central bore 405, 505, 630 of the packer by means of either a wireline or coiled tubing.

It is preferred that the packers 400, 500, 600 are run into the wellbore as part of the coiled tubing string 230. In this instance, the packers 400, 500, 600 will generally be held in place by means of the elastomeric rings 415, 515, 615. However, the packers 400, 500, 600 may optionally also each include a set of slips (not shown) that ride on cones (also not shown) in response to mechanical or hydraulic forces exerted through a setting tool. The use of a setting tool for mechanically or hydraulically actuating cones is well known in the art. A general packer that is set using a wireline tool is the Vera-Set® packer available from Halliburton Company of Houston, Tex. This packer includes both slips and elastomeric rings, and is provided for general reference.

It is understood that other working strings besides coiled tubing may be used for setting the packers 400, 500, 600 and for injecting fluids. The present inventions are not limited by the means in which the packers 400, 500, 600 are run into the wellbore or are set.

Alternate embodiments of a bypass packer may be employed. Two such alternate embodiments are provided in FIGS. 7 and 8.

Figure 7:
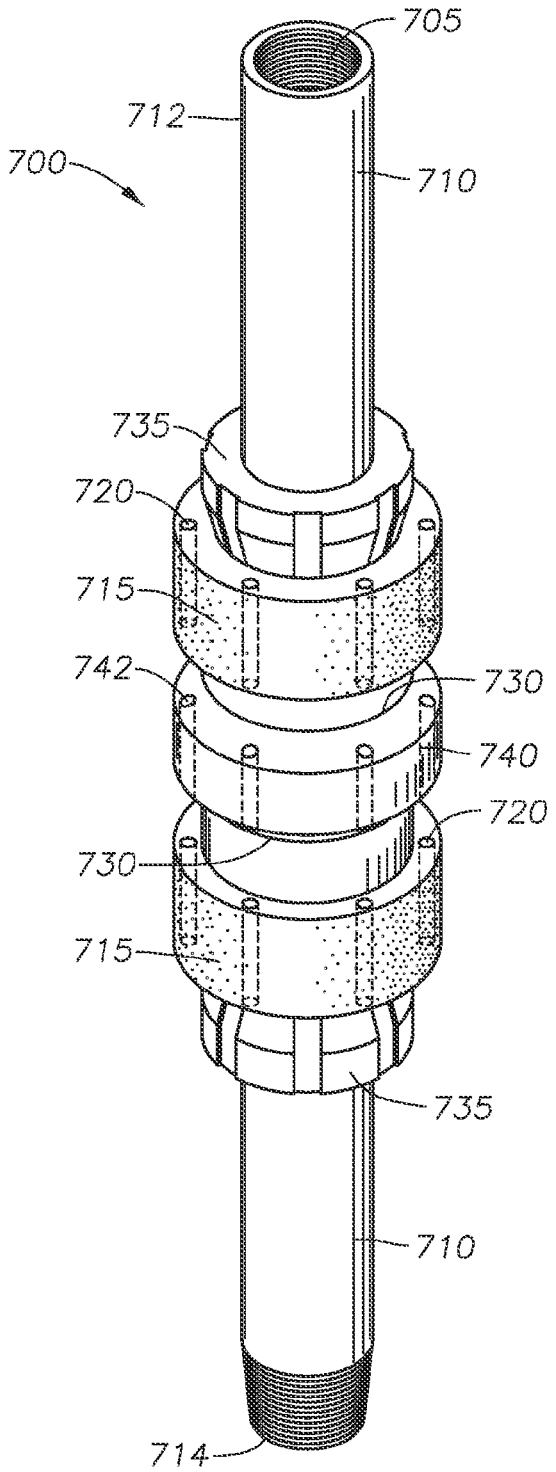
FIG. 7 is a perspective view of a bypass packer as may be used in the wellbore assembly of FIGS. 2 and 3, in another alternate embodiment. The bypass packer employs one or more sealing elements with longitudinal bypass channels therein.

First, FIG. 7 provides a perspective view of a bypass packer 700 as may be used in the wellbore assembly of FIGS. 2 and 3, in one alternate embodiment. Here, the packer 700 comprises one or more large elastomeric rings 715, with a plurality of bypass channels 720 formed longitudinally in the rings 715. The elastomeric rings 715 are placed along a tubular body 710. The tubular body 710 includes an enlarged outer diameter portion forming a pair of opposing shoulders 730. The shoulders 730 are placed between the elastomeric rings 715.

The bypass packer 700 also includes a pair of opposing cones 735. The cones 735 are translated along the tubular body 710 in response to forces applied by a setting tool (not shown). The cones 735 ride under the elastomeric rings 715 to urge them outwardly. As the cones 735 move under the elastomeric rings 715, the shoulders 730 will abut the rings 715. In this way, the rings 715 move primarily radially outwardly against the surrounding casing 106 rather than longitudinally.

A bypass ring 740 is optionally provided along the shoulder 730. The bypass ring 740 includes channels 742. The channels 742 are generally aligned with channels 720 in the elastomeric rings 715. Thus, after the elastomeric rings 715 have been expanded into engagement with the surrounding casing 106, fluid communication is protected between the channels 720 in the two rings 715. Together, the channels 720, 742 impart the desired pressure drop.

It is understood that, as with channels 520 in packer 500, channels 720 in packer 700 provide through-openings to allow injection fluid to flow along the annulus 235. The channels 720 together form a flow-through area that is dimensioned to create a desired pressure drop. The channels 720 may also be selectively plugged using solid plugs or gaskets (not show) to increase the pressure drop.

In one aspect, channels 720 in the two elastomeric rings 715 have different cross-sectional sizes. In this way, a first sub-pressure drop followed by a second sub-pressure drop combine to create the total desired pressure drop. In another aspect, the packer 700 offers yet a third elastomeric ring 715 providing yet another sub-pressure drop. Alternatively, the channels 742 in the bypass ring 740 may also be sized to impart a sub-pressure drop.

Figure 8:
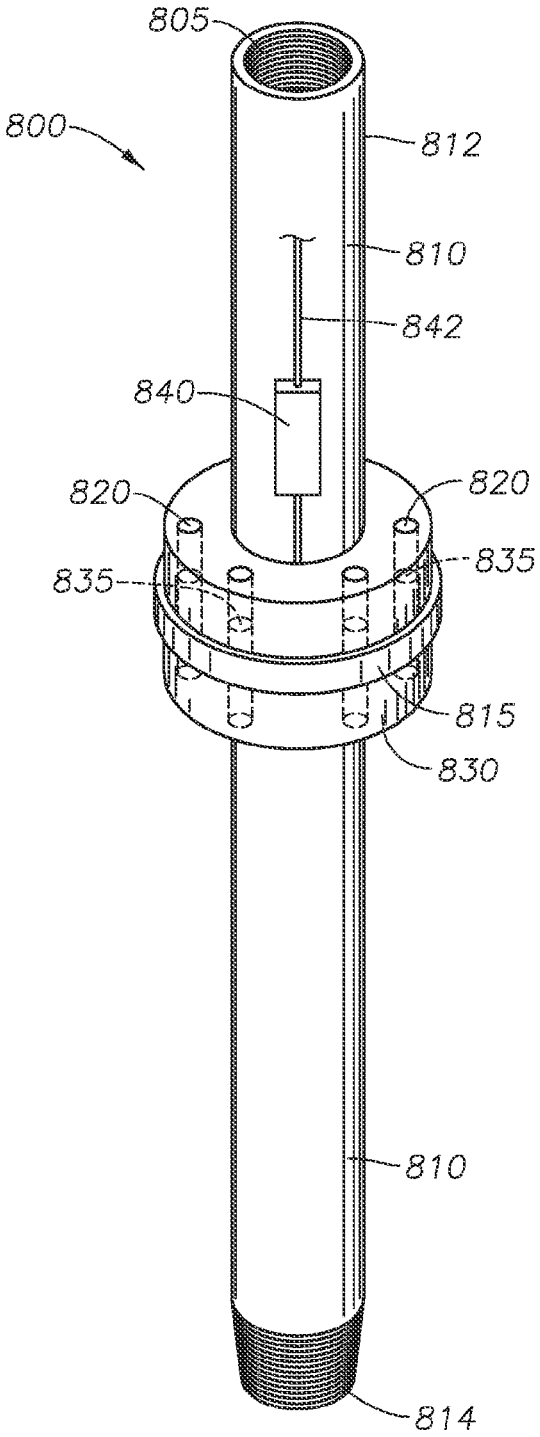
FIG. 8 is a perspective view of a bypass packer as may be used in the wellbore assembly of FIGS. 2 and 3, in still another alternate embodiment. The bypass packer is essentially an enlarged collar that employs bypass channels therein.

FIG. 8 is another perspective view of a bypass packer 800 as may be used in the wellbore assemblies of FIGS. 2 and 3, in still another alternate embodiment. Here, the bypass packer 800 is an enlarged collar 830 that employs two or more bypass channels 820 therein. The channels 820 together form a flow-through area that is dimensioned to create a desired pressure drop.

An elastomeric ring 815 may be placed around the collar 830. The elastomeric ring 815 assists in sealing the annulus 235, thereby forcing injection fluids to flow through the channels 820.

In one embodiment, the bypass packer 800 may contain a control system 840. The control system 840 includes an on-board processor that operates valves, shown schematically at 835. One or more of the valves 835 closes in response to a closure signal sent from the processor 840.

The processor 840 may be a passive system that sends the closure signal in response to a signal from the surface, generated by an operator. Such a signal may be an electrical signal or a fiber optic signal sent through line 842. Alternatively, the processor 840 may be an active system that selectively opens and closes valves 835 in response to in situ pressure readings to maintain a desired pressure above the packer 800.

It is noted that a control system may be employed as well with packers 400 and 500. The control system will provide the operator with the ability to adjust pressure across a bypass packer, either automatically through software or manually through a signal that is sent downhole to the packer. In one aspect, the packer includes a pressure sensor and a valve across a selected channel. The valve is configured to automatically enlarge or contract a cross-sectional area of the channel in response to in situ measurements by the pressure sensor.

Figure 9:
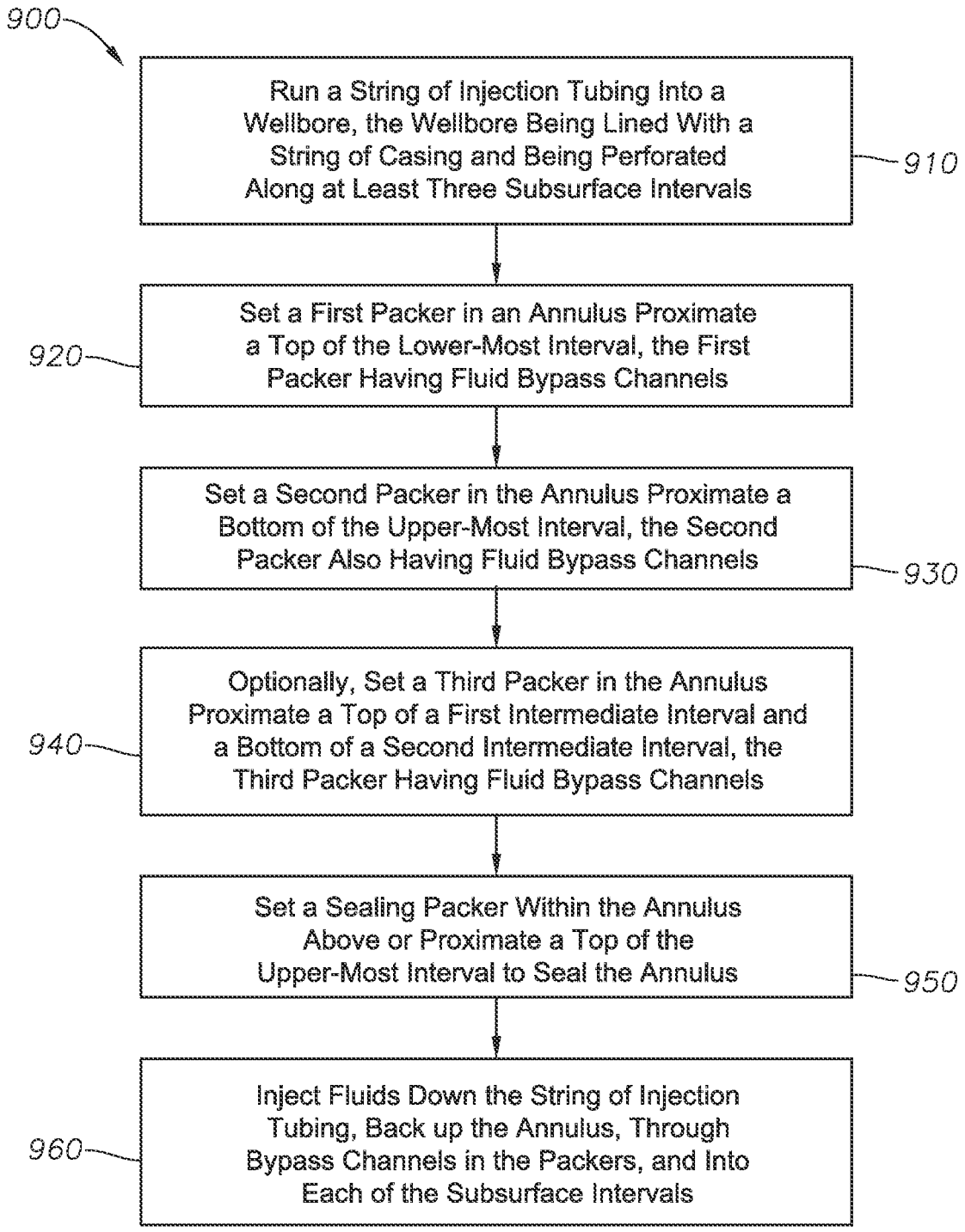
FIG. 9 is a flowchart for a method of injecting fluids into a subsurface formation, in one embodiment. The method involves running a string of tubing into a cased-hole wellbore. Fluids are injected down the tubing string, back up the annulus and through a series of bypass packers that induce incremental pressure drops.

FIG. 9 is a flowchart for a method 900 of injecting fluids into a subsurface formation, in one embodiment. The method 900 involves injecting fluids down a wellbore and back up an annulus while separating the fluid flow into different pressure zones. The purpose is to improve vertical conformance and eliminate stagnant flow regions along the wellbore. Since the fluid is flowing from the bottom of the wellbore back up the annulus, there will be no regions of stagnant flow. Further, because the fluid is being circulated, it is continuously "flushing" the annulus, likely reducing the growth of biofilm and scale that can cause plugging in perforations.

In the method 900, the subsurface formation has at least three subsurface intervals. These intervals define a lower-most interval, an upper-most interval, and a first intermediate interval between the lower-most and upper-most intervals.

The method 900 first includes running a string of injection tubing into a wellbore. This is shown at Box 910. The wellbore is lined with a string of casing. The casing traverses each of the at least three subsurface intervals. Further, the casing is perforated along each of the at least three intervals.

In the wellbore, an annulus is formed between the tubing and the surrounding perforated casing. The annulus represents at least a lower annular region adjacent the lower-most interval, a first intermediate annular region adjacent the first intermediate interval, and an upper annular region adjacent the upper-most interval.

The method 900 also includes setting a first packer. This is provided at Box 920. The first packer is set in the annulus proximate a top of the lower-most interval. The first packer has one or more channels. The channels serve as through-openings that permit fluid communication between the lower annular region and the first intermediate annular region.

The method 900 further includes setting a second packer. This is provided at Box 930. The second packer is set in the annulus proximate a bottom of the upper-most interval. The second packer also has one or more channels. The channels serve as through-openings that permit fluid communication between the upper-most annular region and the first intermediate annular region.

Optionally, the method 900 also includes setting a third packer. This is provided at Box 940. The third packer is set in the annulus proximate a top of the first intermediate interval and a bottom of a second intermediate interval. The third packer also has one or more through openings. The channels serve as through-openings that permit fluid communication between the first intermediate annular region and a second intermediate annular region adjacent a second intermediate interval between the first intermediate interval and the upper-most interval.

The first, second and third packers may be designed in accordance with any of the packers 400, 500, 600, 700, 800 described above, or other packer designs that have bypass channels. The packers are "tunable," meaning that the cross-sectional flow area of the bypass channels may be adjusted to accomplish a desired pressure drop.

The method 900 further includes setting a sealing packer. This is indicated at Box 950. The sealing packer is set within the annulus above or proximate a top of the upper-most interval. The sealing packer serves to seal the annulus essentially above the subsurface formation.

The method 900 also includes injecting fluids down the string of injection tubing. This is seen at Box 960. Box 960 further provides for injecting the fluids back up the annulus, through the bypass channels in the packers, and into each of the three or more subsurface intervals. The channels in the packers are sized to impart incremental pressure drops as the fluid moves up the annulus. This, in turn, optimizes fluid injection into the subsurface intervals.

In one aspect, the one or more channels in the first packer form a first area, while the one or more channels in the second packer form a second area. The first area may be larger than the second area, or the second area may be larger than the first area. The areas may be reduced by providing plugs for sealing selected through-openings.

The present disclosure provides an improved wellbore assembly and method for injecting fluids into intervals along one or more subsurface formations. The assembly and method provide for injecting fluids down the wellbore and back up an annulus. The fluids are forced through different pressure zones to insure the injection of fluids into corresponding intervals along the wellbore. While it will be apparent that the inventions herein described are well calculated to achieve the benefits and advantages set forth above, it will be appreciated that the inventions are susceptible to modification, variation and change without departing from the spirit thereof.

What is claimed is:

1. A method of injecting a fluid into a subsurface formation, the subsurface formation having at least two subsurface intervals, and the method comprising:

running a string of injection tubing into a wellbore, the wellbore being lined with a string of casing that substantially traverses each of the at least two subsurface intervals, with the casing being perforated along each of the at least two intervals and an annulus being formed between the tubing and the surrounding perforated casing;

setting a bypass packer along the string of tubing intermediate the at least two subsurface intervals, the bypass packer having a defined flow-through area that is sized to impart a defined incremental pressure drop so as to optimize fluid injection into the at least two subsurface intervals;

setting a sealing packer within the annulus above or proximate a top of an upper-most of the at least two subsurface intervals to seal the annulus; and injecting fluids down the string of injection tubing, back up the annulus, through the channels in the bypass packer, and into each of the at least two subsurface intervals.

2. The method of claim 1, wherein the defined flow-through area comprises at least two distinct channels.

3. The method of claim 1, wherein the flow-through area defined by the at least two channels is adjustable.

4. The method of claim 1, wherein:

the at least two subsurface intervals is at least three subsurface intervals that comprise a lower-most interval, an upper-most interval, and a first intermediate interval between the lower-most and upper-most intervals;

the string of casing substantially traverses each of the at least three subsurface intervals and is perforated along each of the at least three subsurface intervals;

setting a packer further comprises setting a series of bypass packers along the string of tubing, with each bypass packer having a defined flow-through area sized to impart an incremental pressure drop to optimize fluid injection into the at least three subsurface intervals; and injecting fluids comprises injecting fluids down the string of injection tubing, back up the annulus, through the channels in the bypass packers, and into each of the at least three subsurface intervals.

5. The method of claim 4, wherein setting a series of packers comprises:

setting a first packer in the annulus proximate a top of the lower-most interval, the first packer having one or more bypass channels to permit fluid communication between a lower annular region adjacent the lower-most interval and a first intermediate annular region adjacent the first intermediate interval; and setting a second packer within the annulus proximate a bottom of the upper-most interval, the second packer having one or more bypass channels to permit fluid communication between an upper-most annular region adjacent the upper-most interval and the first intermediate annular region.

6. The method of claim 5, further comprising:

setting a third packer within the annulus proximate a top of the first intermediate interval, the third packer having one or more bypass channels to permit fluid communication between the first intermediate annular region and a second intermediate annular region adjacent a second intermediate interval between the first intermediate interval and the upper-most interval; and the step of injecting fluids further comprises injecting fluids through the channels in the third packer, wherein the one or more channels in the third packer also form a flow-through area that is sized to impart an incremental pressure drop as fluid moves up the annulus from the first intermediate annular region into the second intermediate annular region.

7. The method of claim 6, wherein the second packer is set proximate a bottom of the second intermediate interval.

8. The wellbore assembly of claim 6, further comprising:

running a second string of tubing into the wellbore, the second string of tubing extending along at least the upper-most interval;

wherein the sealing packer and at least the third packer are configured to threadedly receive each of the first string of tubing and the second string of tubing.

9. The method of claim 5, wherein the method further comprises:

(i) manually placing one or more plugs into selected channels in the first packer to reduce the flow-through area in the first packer; (ii) manually placing one or more plugs into selected channels in the second packer to reduce the flow-through area in the second packer; or (iii) both.

10. The method of claim 9, wherein the flow-through area in the second packer is smaller than the flow-through area in the first packer.

11. The method of claim 9, wherein the flow-through area in the second packer is larger than the flow-through area in the first packer.

12. The method of claim 5, wherein:

each of the first packer and the second packer comprises a collar having an elastomeric sealing element placed circumferentially there around;

the one or more bypass channels in the first packer are placed longitudinally within the collar of the first packer; and the one or more bypass channels in the second packer are placed longitudinally within the collar of the second packer.

13. The method of claim 5, wherein:

each of the first packer and the second packer comprises an elastomeric sealing element;

the step of setting the first packer comprises extruding the sealing element of the first packer into engagement with the surrounding string of casing; and the step of setting the second packer comprises extruding the sealing element into engagement with the surrounding string of casing.

14. The method of claim 5, wherein:

each of the first packer and the second packer comprises an elastomeric sealing element placed circumferentially there around;

the one or more bypass channels in the first packer are placed longitudinally through the sealing element of the first packer; and the one or more bypass channels in the second packer are placed longitudinally through the sealing element of the second packer.

15. The method of claim 5, wherein each of the first packer and the second packer is instrumented to monitor (i) flow rate, (ii) wellbore temperature, (iii) absolute pressure, (iv) differential pressure, or (v) combinations thereof.

16. The method of claim 15, further comprising:

in response to a pressure reading along the first packer, sending a signal from a processor to adjust the flow-through area in the first packer.

17. The method of claim 16, further comprising:

in response to a pressure reading along the second packer, sending a signal from a processor to adjust the flow-through area in the second packer.

18. The method of claim 16, wherein the flow-through area is adjusted by movement of a valve within one or more of the bypass channels in the first packer.

* * * * *